US006702602B2

(12) United States Patent
Wu

(10) Patent No.: US 6,702,602 B2
(45) Date of Patent: Mar. 9, 2004

(54) ELECTRICAL CONNECTOR HAVING IMPROVED LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 36 days.

(21) Appl. No.: 10/235,290

(22) Filed: Sep. 4, 2002

(65) Prior Publication Data

US 2004/0023545 A1 Feb. 5, 2004

Related U.S. Application Data

(63) Continuation-in-part of application No. 10/209,553, filed on Jul. 30, 2002.

(51) Int. Cl.[7] ..... H01R 13/627
(52) U.S. Cl. ..... 439/352; 439/357
(58) Field of Search ..... 439/350–358, 439/372, 607, 610

(56) References Cited

U.S. PATENT DOCUMENTS 3,548,455 A * 12/1970 Ezure ..... 439/352
4,634,204 A * 1/1987 Detter et al. ..... 439/347
5,564,939 A 10/1996 Maitani et al.
5,634,809 A * 6/1997 Hirai ..... 439/352
5,951,316 A * 9/1999 Kawano et al. ..... 439/352
6,394,842 B1 * 5/2002 Sakurai et al. ..... 439/607

* cited by examiner

*Primary Examiner*—Hien Vu
(74) *Attorney, Agent, or Firm*—Wei Te Chung

(57) ABSTRACT

An electrical connector (1) includes a bottom housing (10) and a top housing (20) assembled together. The bottom housing and top housing each define a pair of channels (121, 221). A pair of beams (80) has a first block (81) and a second block (85). The first block and the second block each has an arch (84,86). Each beam has a latch releasing portion (83) at a free end thereof. A pair of operating bars (50) has an operation portion (51) and an arm (52) extending from the operation portion, each arm having a retention member (510) formed on outer surface thereof. A pair of latches (70) each has a first claw portion (72) engaging with the bottom housing, a second claw portion (73) for engaging with a complementary connector, and a sloping portion (712) between the first and second claw portion.

6 Claims, 9 Drawing Sheets

ELECTRICAL CONNECTOR HAVING IMPROVED LATCH MECHANISM

CROSS-REFERENCES TO RELATED APPLICATIONS

This application is a continuation-in-part of U.S. patent application Ser. No. 10/209,553 filed on Jul. 30, 2002 and entitled "ELECTRICAL CONNECTOR HAVING A LATCH MECHANISM", and is related to a copending U.S. Patent Application with an unknown serial number and entitled "ELECTRICAL CONNECTOR HAVING ENGAGING DEVICE", which are invented by the same inventor and assigned to the same assignee as this application and which are hereby fully incorporated by reference.

BACKGROUND OF THE INVENTION

1. Field of the Invention

The present invention relates to an electrical connector, and particularly to an electrical connector having an improved latch mechanism for engaging with and releasing from a mated complementary connector 2. Description of Prior Art Referring to U.S. Pat. No. 5,564,939 issued on Oct. 15, 1996 to Maitani, et al. A conventional electrical connector disclosed in the patent has a pair of latches 22 and 22A respectively attached on opposite sides of a housing 21 of the connector. An operating member 23 has a pair of latch releasing cams 23-4 located below angled portions 22-4 of the latches 22, 22A. When an operator pulls a pull tab 23-8 of the operating member 23 backwardly, the latch releasing cams 23-4 exert outward forces on the angled portions 22-4 and U-shaped claws 22-1 slip out to release a mated complementary connector. Because the operating member 23 and the spring latch 22, 22A are positioned outside of the housing 21, they are easy to be damaged when a force is exerted thereon. In addition, because the construction of the spring latch is very thin, it is easy to be damaged when the connector mates with the mated complementary connector. Therefore, an electrical connector with an improved latch mechanism is desired to resolve the above-mentioned problems or disadvantages.

SUMMARY OF THE INVENTION

It is an objective of the present invention to provide an electrical connector having an improved latch mechanism assembled therein for firmly engaging with and releasing from a mated complementary connector.

In order to achieve the object above-mentioned, an electrical connector in accordance with the present invention includes a bottom housing and a top housing assembled together. The bottom housing and top housing each define a pair of channels. A pair of beams has a first block and a second block. The first block and the second block each has an arch. Each beam has a latch releasing portion at a free end thereof. A pair of operating bars has an operation portion and an arm extending from the operation portion, each arm having a retention member formed on outer surface thereof. A pair of latches each has a first claw portion engaging with the bottom housing, a second claw portion for engaging with a complementary connector, and a sloping portion between the first and second claw portion. When the operating bars are pulled rearwards, the beams are moved rearwards by the retention member of the operating bars, the latch releasing portions push the sloping portions, the sloping portions deflect outwardly to motivate the second claws to move outwardly accordingly whereby a latch of the second claws with the complementary connector is released.

Other objects, advantages and novel features of the invention will become more apparent from the following detailed description when taken in conjunction with the accompanying drawings.

DETAILED DESCRIPTION OF THE INVENTION

Figure 1:
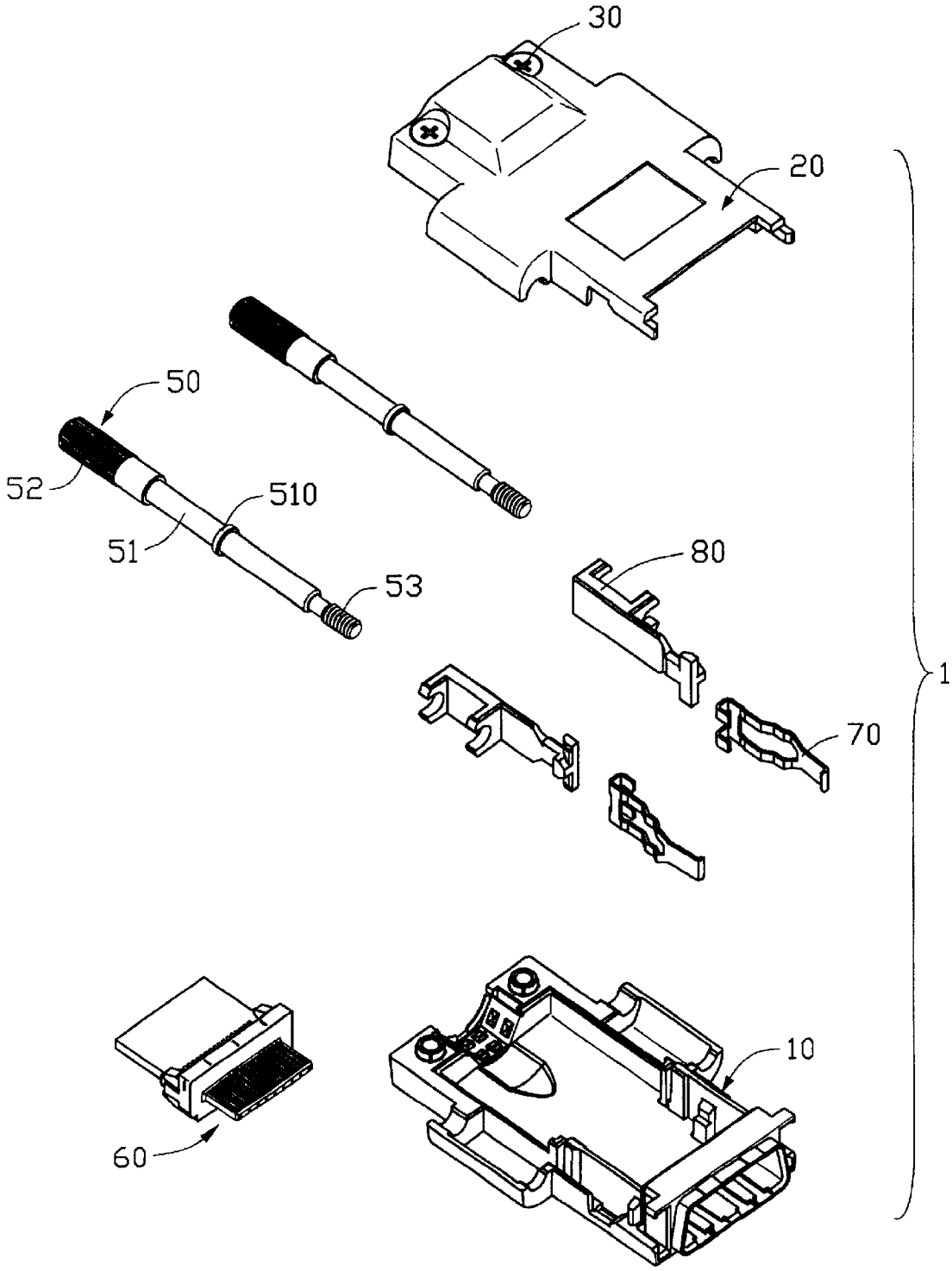
FIG. 1 is an exploded perspective view of an electrical connector in accordance with the present invention.

Referring to FIG. 1, an electrical connector 1 in accordance with the present invention comprises a bottom housing 10, a top housing 20 for being assembled to the bottom housing 10, a pair of bolts 30 for securing the top housing 20 on the bottom housing 10, a pair of operating bars 50, a terminal insert 60, a pair of latches 70, and a pair of beams 80.

Figure 2:
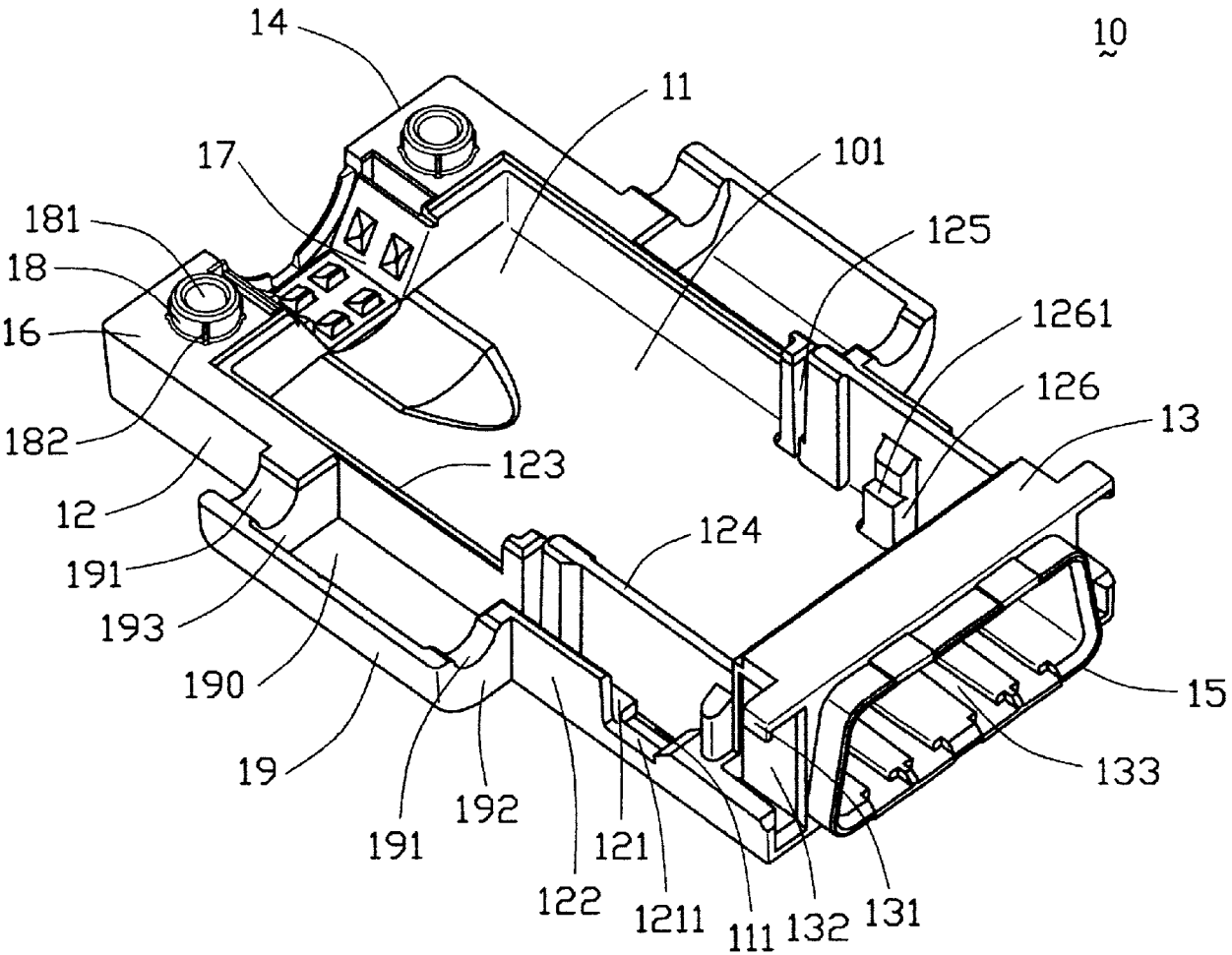
FIG. 2 is an enlarged perspective view of a bottom housing shown in FIG. 1.

Referring to FIG. 2, the bottom housing 10 and the top housing 20 made of die casting metallic material define a lower chamber 11 and an upper chamber 21, respectively, for cooperatively enclosing the cable (not shown) therebetween. Additionally, the bottom housing 10 and the top housing 20 respectively define a lower receiving port 17 substantially semicircular communicated with the lower chamber 11 and an upper receiving port substantially semicircular 27 communicated with the upper chamber 21. The bottom housing 10 comprises a base plate 101, a pair of sidewalls 12 upwardly extending from opposite lateral sides of the base plate 101 and a pair of limbs 19 outwardly extending from the corresponding sidewalls 12. The limb 19 has a front and rear portion 192, 193 and a receiving space 190 formed therein. The front and rear portion 192, 193 each has an arc recess 191 on a top face thereof. Each sidewall 12 defines an elongated channel 121 from the receiving space 190 toward a front end 15 of the bottom housing 10 and through a top engaging face 16 thereof, Each sidewall 12 is divided into an outer wall 122 and an inner wall 123 by the channel 121. The inner walls 123 each have a higher shoulder portion 124 adjacent to the front end 15. The shoulder portions 124 each define a vertical slit 125 at a rear end thereof. The outer walls 122 each define a cutout 1211 adjacent to the front end 15. A pair of blocks 126 is formed on inner sides of the shoulder portions 124 of the inner walls 123. Each block 126 defines a step portion 1261. The base plate 101 defines a pair of grooves 111 each being located between the shoulder portion 124 of a corresponding inner wall 123 and a corresponding cutout 1211. A mating frame 13 is formed at the front end 15 of the bottom housing 10. The mating frame 13 defines an opening 133 through the front end 15. A pair of engaging ears 131 is formed on opposite sides of a top of the mating frame 13 and extends laterally. A pair of engaging spaces 132 is defined in opposite sides of the mating frame 13 and between the engaging ears 131 and the base plate 101. A pair of posts 18 protrudes upwardly from the engaging face 16, located respectively at opposite sides of the first receiving port 17. Each post 18 defines a operating bar hole 181 therein and has four ribs 182 on a circumferential periphery thereof.

Figure 3:
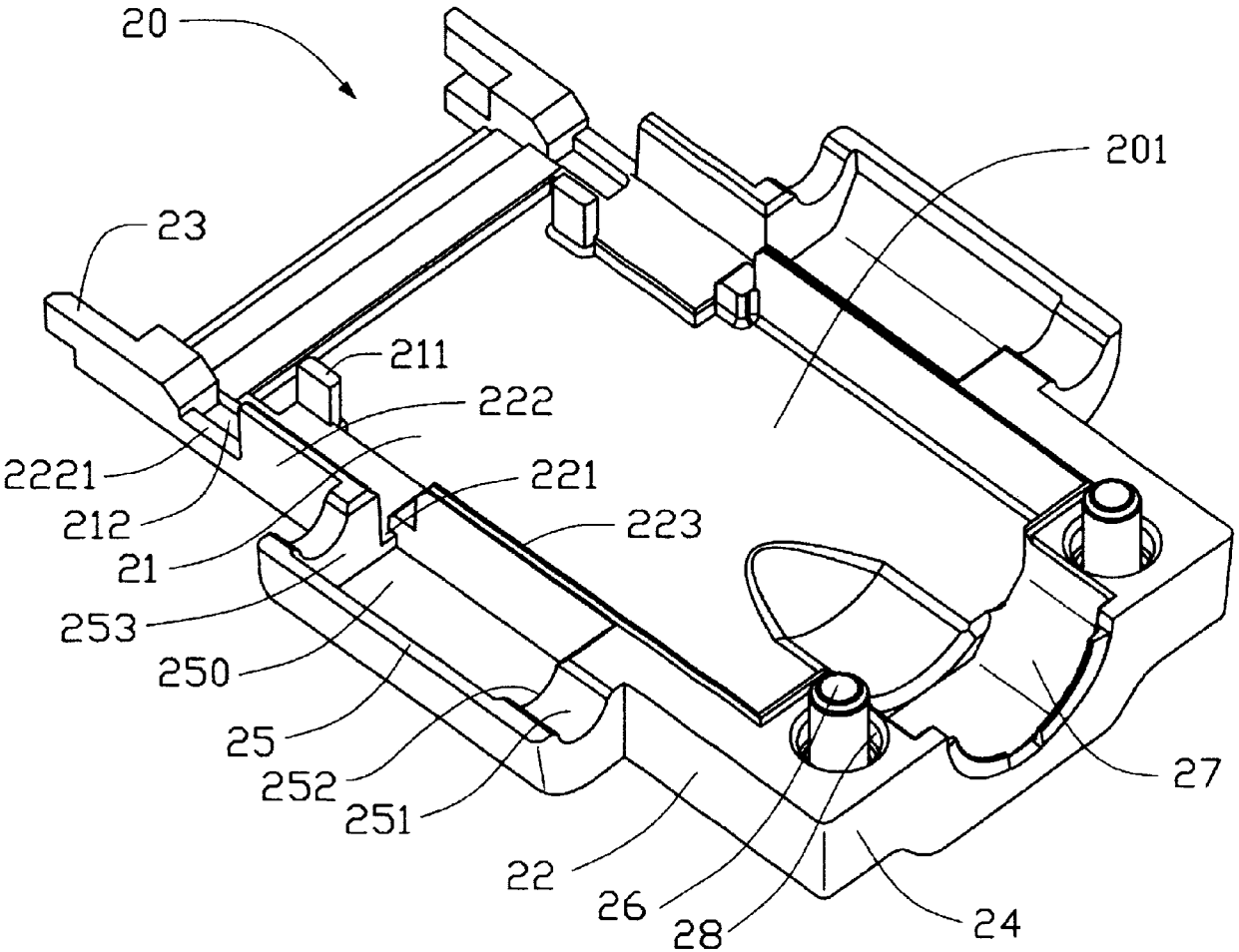
FIG. 3 is an enlarged perspective view of a top housing shown in FIG. 1 from a bottom aspect.

Referring to FIG. 3, the top housing 20 comprises a top housing plate 201, a pair of sidewalls 22 downwardly extending from opposite lateral sides of the top housing plate 201 and a pair of limbs 25 outwardly extending from the corresponding sidewalls 22. The limb 25 has a front and rear portion 253, 252 and a receiving space 250 formed therein. The second front and rear portion 253, 252 each has an arc recess 251 on a bottom face thereof. Each sidewall 22 defines an elongated channel 221 corresponding to the channel 121 of the bottom housing 10. Each sidewall 22 is divided into an outer wall 222 and an inner wall 223 by the channel 221. A pair of blocks 211 extends downwardly from the top housing plate 21 corresponding to the blocks 126. A pair of grooves 212, corresponding to the grooves 111 in the bottom housing 10, is defined in the top housing plate 21 in inner sides of a pair of cutouts 2221 which is corresponding to the cutouts 1211 in the bottom housing 10. A pair of projections 23 extends forwardly from opposite sides of a front end the top housing plate 201. A semicircular second opening 27 is defined in a rear end 24 of the top housing plate 21 corresponding to the first opening 17 of the bottom housing 10. A pair of holes 28 is defined in opposite sides of the second opening 27. Each hole 28 has a diameter generally equal to an outer diameter of each of the posts 18.

Each operating bar 50 shaped cylinder has a head 52 and an arm 51 extending from the head 52. Each arm 51 has a retention member 510 formed on outer surface thereof and has external threads 53 at a rearmost end thereof. An outer diameter of the arm 51 is larger than an outer diameter of the external threads 53, but lesser than an outer diameter of the operation portion 51.

Figure 4:
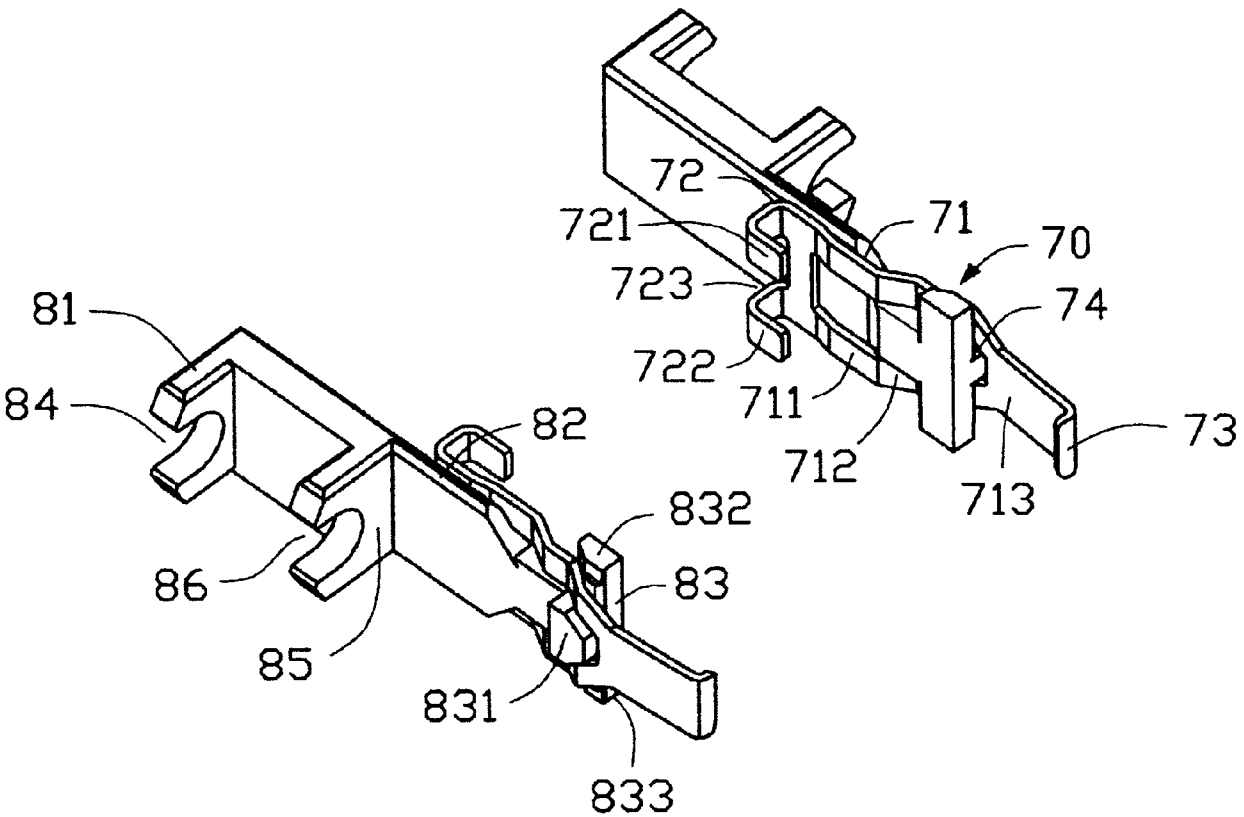
FIG. 4 is an enlarged perspective view of latches and beams shown in FIG. 1.

Referring to FIG. 4, each of the latches 70 is formed by stamping a metal sheet and has a body portion 71, a U-shaped claw portion 72 formed at a rear end of the body portion 71, and an L-shaped claw portion 73 formed at a front end of the body portion 71. An elongated cutout 74 is defined in the body portion 71 in a front to rear direction. The body portion 71 comprises a rear portion 711, a middle portion 712, and a front portion 713 extending inwardly from the middle portion 712. The middle portion 712 comprises a front slope portion 714, a rear slope portion 715, and an intermediate portion 716 between the front and rear slope portions 714, 715.

The beams 80 each comprises a main body 82, a first block 81 projecting sidewardly from one end of the main body 82, a latch releasing portion 83 formed at the other end of the main body 82 and a second block 85 projecting sidewardly from the main body 82 between the first block 81 and the latch releasing portion 83.The first and second blocks each has arches 84, 86. Each latch releasing portion 83 has upper and lower tip ends 832, 833, and a protrusion 831 protruding outwardly from an outside face thereof.

Figure 5:
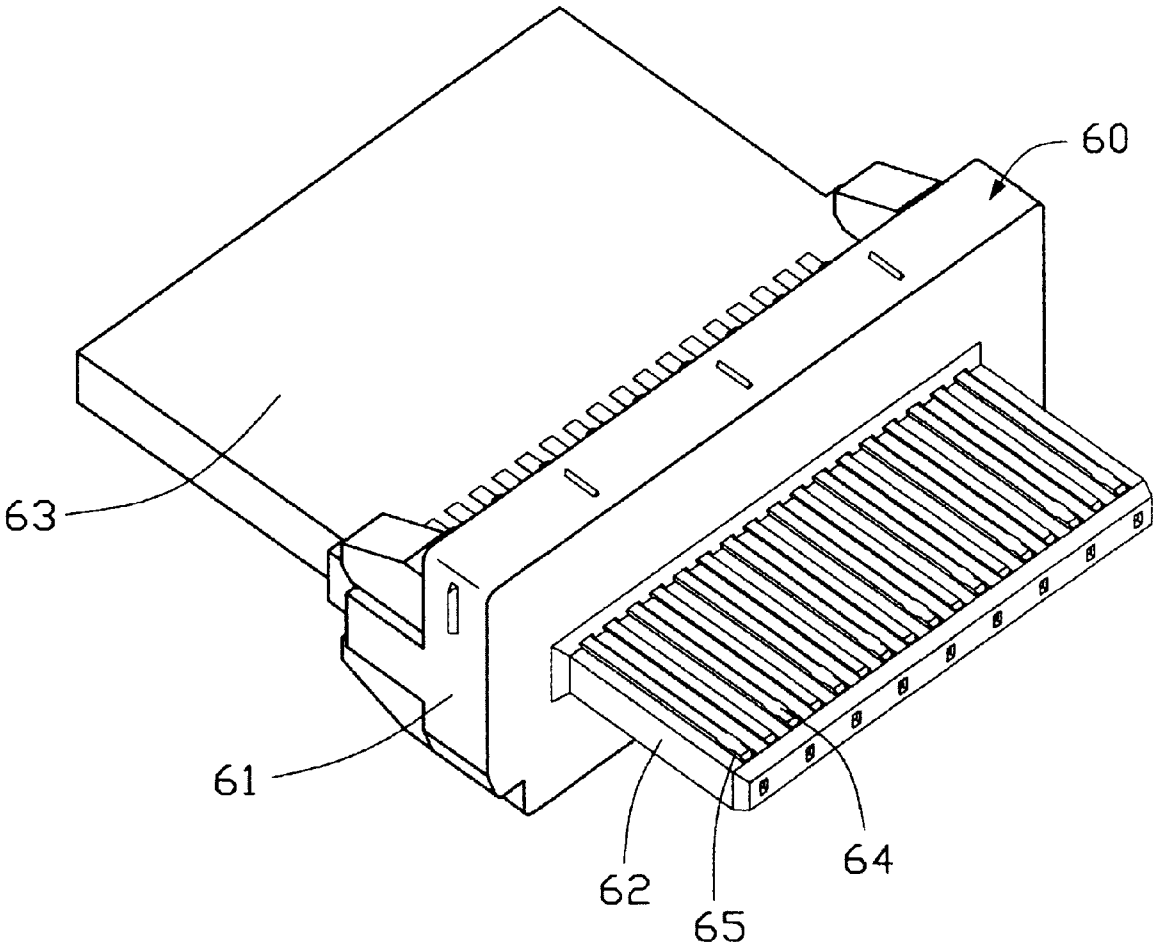
FIG. 5 is an enlarged perspective view of a terminal insert shown in FIG. 1.

Referring to FIG. 5, the terminal insert 60 comprises an insulating body 61, a tongue portion 62 extending forwardly from the body 61, a printed circuit board (PCB) 63 assembled to a rear side of the body 61. A plurality of passageways 65 is defined in upper and lower surfaces of the tongue portion 62. A plurality of terminals 64 is received in the passageways 65 of the tongue portion 62 and extends through the body 61 to electrically connect the PCB 63.

Figure 6:
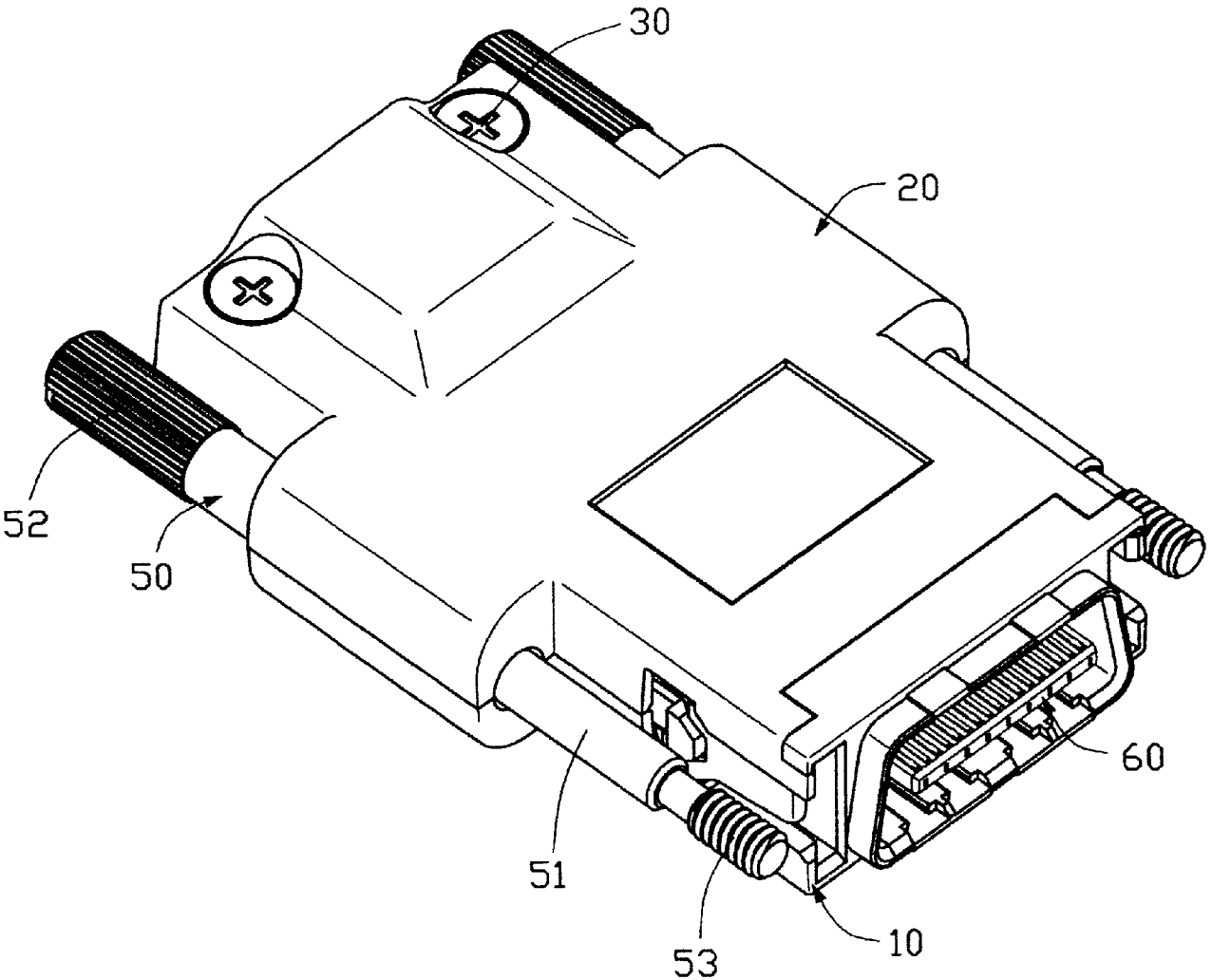
FIG. 6 is an enlarged assembled view of the electrical connector shown in FIG. 1.
Figure 7:
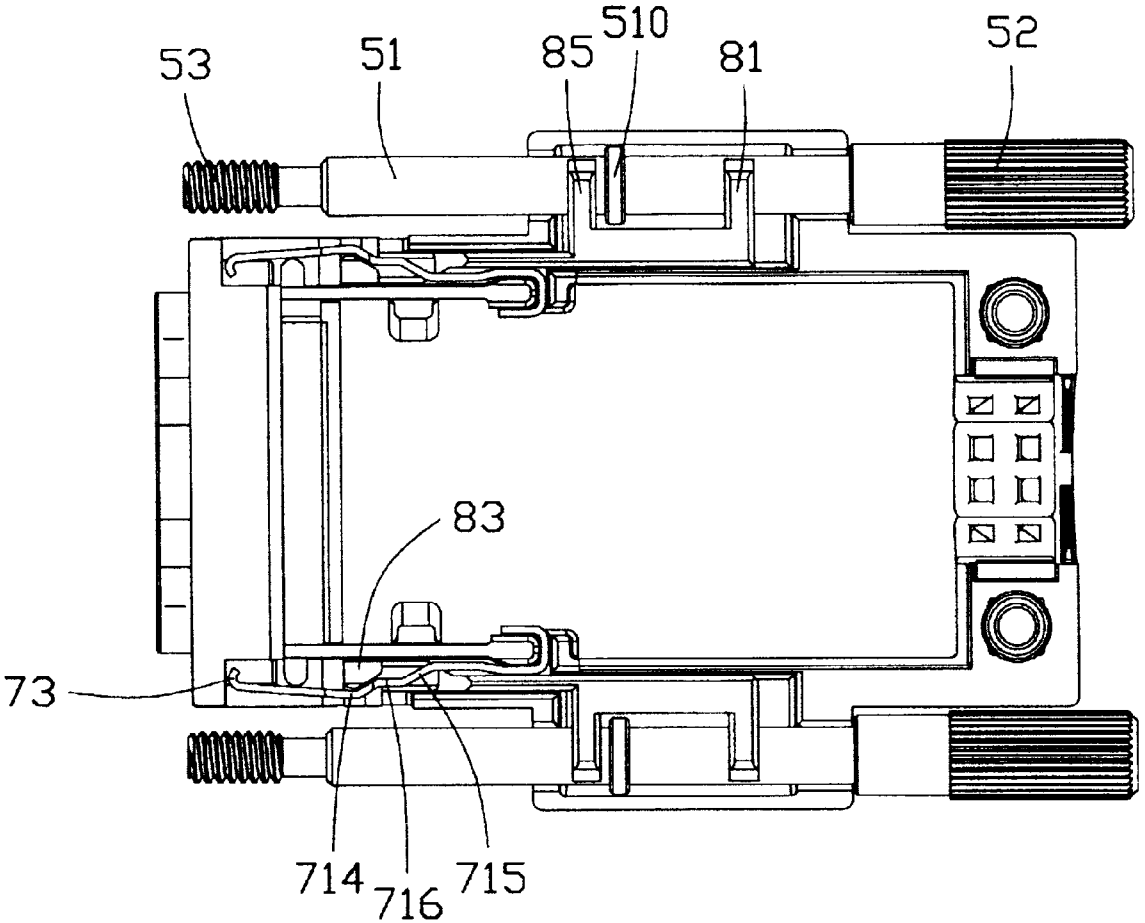
FIG. 7 is a top view of FIG. 6 with the top housing being removed, in which the latches are located at a close position so as to engage with a mating connector.

Referring to FIGS. 6 and 7, in assembly, the terminal insert 60 is assembled to the bottom housing 10 with the tongue portion 62 received in the opening 133. The PCB 63 is received in the bottom housing 10 between the two sidewalls 12 and positioned upon the step portions 1261 of the blocks 126. The two latches 70 are respectively assembled to the beams 80 by extending the protrusions 831 into the cutouts 74 from inner faces of the latches 70, whereby the latch releasing portions engage with the inner faces of the latches 70, respectively. The latch releasing portions 83 are positioned at the inner faces of the front portions 713 and the protrusions 831 are fitted into front portions of the cutouts 74. Then, the latches 70 together with the beams 80 are assembled to the bottom housing 10. The latch releasing portions 83 are placed into the channels 121 with the first and second blocks 81, 85 being received in the receiving space 190, 250 of the limb 19, 25. The U-shaped claw portions 72 are received into the slits 125 and engaged with rear ends of the shoulder portions 124 to secure the latches 70 to the bottom housing 10. The PCB 63 is located in the gap 723 between the upper and lower U-shaped claw portions 721, 722. The lower tip ends 833 of the latch releasing portions 83 are placed in the grooves 111 with the protrusions 831 extending into the cutouts 1211. The L-shaped claw portions 73 extend into the engaging spaces 132 for latching with a complementary connector (not shown). The operating bars 50 extend through the receiving space 190, 250. The arm 51 of the operating bars 50 align with the arches 84, 86 in the traverse direction and the operating bars 50 are moved into the arches 84, 86 in the traverse direction so that the retention member 510 of the operating bar 50 is limited to move between the first block 81 and the second block 85 in a longitudinal direction. The top housing 20 is assembled to the bottom housing 10 by placing the projections 23 beneath the pair of engaging ears 131. Then a rear portion of the top housing 20 is rotated downwardly about the pair of engaging ears 131 until a bottom face of the top housing 20 intimately abuts the top engaging face 16 of the bottom housing 10. Upper portions of the main body 82 are received in the channels 221 and the upper tip ends 832 of the latch releasing portions 83 are received into the grooves 212 of the top housing 20. The blocks 211 abut a top face of the PCB 63 above the step portions 1261 of the blocks 126 to secure the PCB 63 in position. The posts 18 are received into the holes 28 with the four ribs 182 engaging with inner surfaces of the holes 28. The first and second openings 17 and 27 together form a cable receiving opening for extension of a cable (not shown) therethrough. Finally, the bolts 30 are screwed into the screw holes 181 to securely fasten the top housing 20 and the bottom housing 10 together, whereby the electrical connector 1 in accordance with the present invention is obtained.

An operation of the electrical connector 1 in introduced below.

Referring to FIG. 7, when the complementary connector (not shown) is mated with the electrical connector I of the present invention, the heads 52 of the operating bars 50 are rotablely forwardly driven, so that the external threads 53 fully engage with nuts of the complementary connector, and the latch releasing portions 83 of the beam 80 abut against the front slope portions 714 of the latch springs 70. Therefore, the L-shaped claw portions 73 clamp corresponding engaging portions of the complementary connector (not shown). When the connector is fully mated with the complementary connector (not shown), the heads 52 of the operating bars 50 abut against an outer face of rear portion 192, 252.

Figure 8:
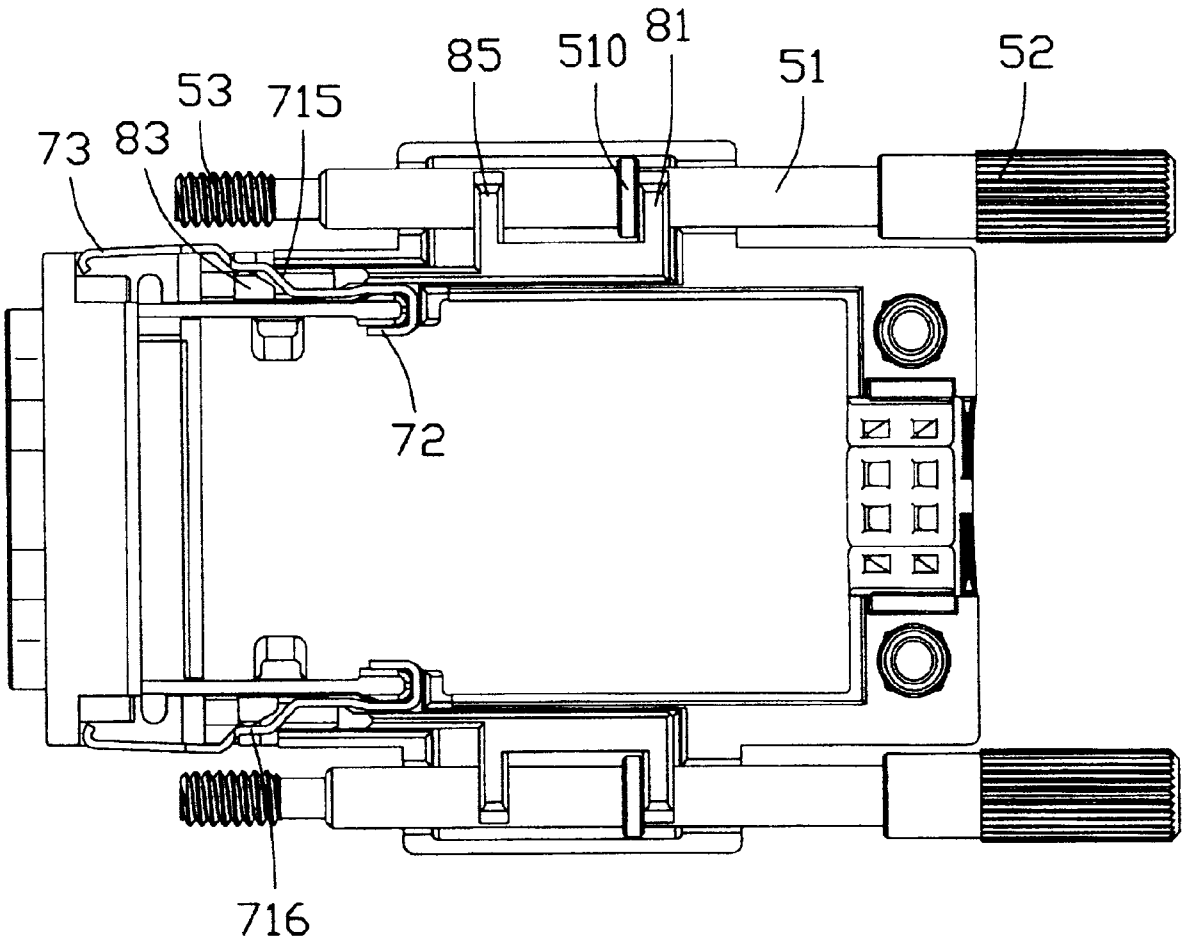
FIG. 8 is a view similar to FIG. 7, the latches meet the pull tab showing the latches being moved to an open position.

Referring to FIG. 8, when the electrical connector is separated from the complementary connector by the following operation. Firstly by rotating adversely the head 52 of the operating bar 50 until the external threads 53 are loosely unengaged with nuts of the complementary connector, and then the operating bars 50 are pulled rearwardly, the retention members 510 pull the first blocks 81 of the beams 80 rearwardly until the first blocks 81 abut against an inner side of the first and second rear portion 192, 253. The upper and lower tip ends 832, 833 slide in the grooves 111, 212 and the protrusions 831 slide in the cutouts 74, the latch releasing portions 83 come into contact with the intermediate portions 716, they exert an outward force on inner faces of the intermediate portions 716. The latch springs 70 are elastically deformed and the front portions 713 are pushed outwards in a lateral direction. Thus, the L-shaped claw portions 73 are driven to separate from the engaging portions of the complementary connector (not shown). Hence, the electrical connector 1 is pulled out from the complementary connector.

Figure 9:
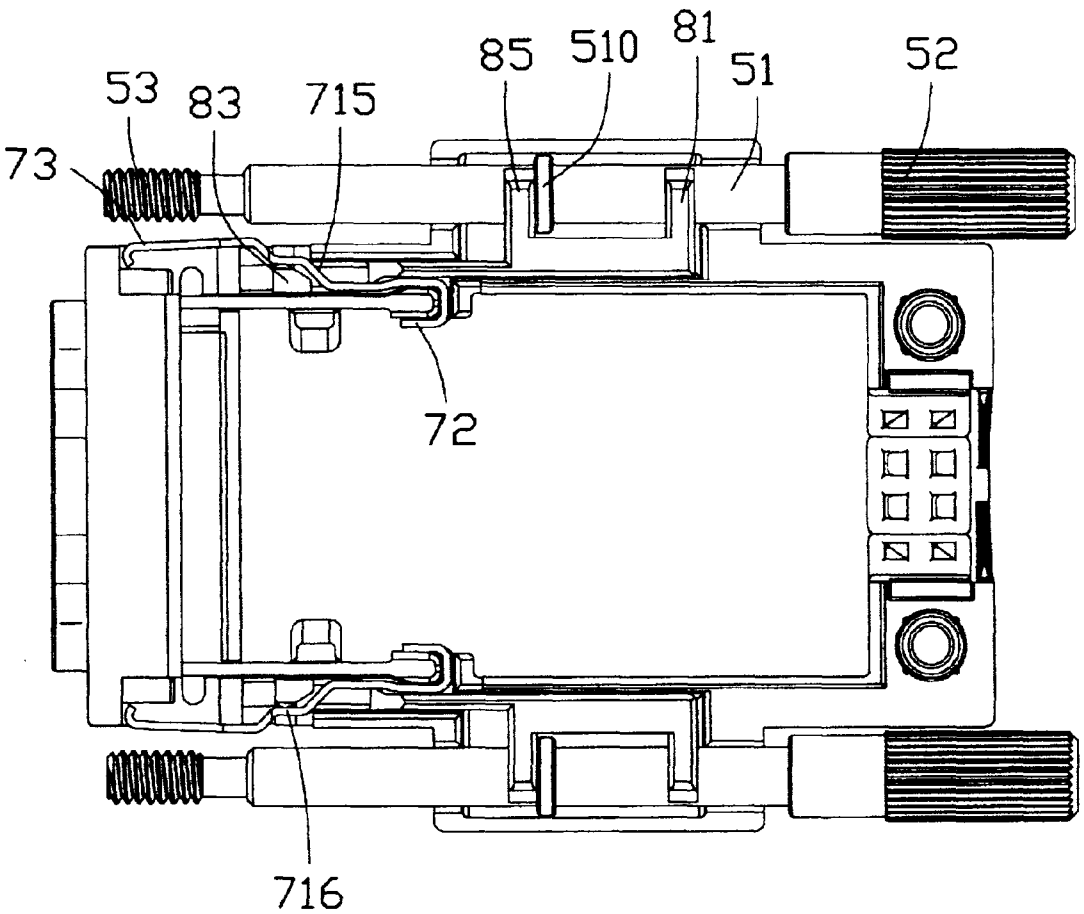
FIG. 9 is a view similar to FIG. 8, in which the latches are located at a full open position.

Referring to FIG. 9, before the connector mates with the complementary connector (not shown), the operator pushes the operating bars 50 forwardly, the retention members 510 firstly meet the second blocks 85 of the pull tab 80. When the operator continues to push the operating bars 50 forwardly referring to FIG. 7, the retention members 510 push the second blocks 85 of the pull tab 80 forwardly and the upper tip ends 832 immediately leave the intermediate portions 716 to contact the front slope portions 714. A spring force of the sloping portions 713 of the latch springs 70 drives the L-shaped claw portions 73 resume to original position, as shown in FIG. 7. Hence, the improved latch mechanism provides a better fixation between the connector and the complementary connector (not shown) when the connector is mated with the complementary connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

a housing defining a receiving space;

a plurality of terminals attached to the housing;

a fastener having a head at one end thereof and external threads at the other end thereof for engaging with nuts of the complementary connector;

a beam received in the receiving space and having a latch releasing portion at a free end thereof;

a latch received in the received space and cooperating with the beam for engaging with a hook of the complementary connector;

wherein when the fastener is pulled rearwardly in a longitudinal direction by gripping the head, the latch releasing portion of the beam is pulled rearwardly and deflects the latch in a lateral direction for separating from the hook of the complementary connector, thereby the connector is released; when the electrical connector is adapted to mate with the complementary connector, the fastener drives the beam forwardly with outer threads engaging with the nuts of the complementary connector and makes the latch to resume to original position for engaging with the hook of the complementary connector; wherein the housing comprises a bottom housing and a top housing assembled together; wherein the bottom housing has a first limb projecting outwardly from sidewalls thereof, and the top housing has a second limb related to the first limb; wherein when the connector is mated with the complementary connector, the head of the fastener abuts against a rear face of the limbs; wherein the beam comprises a first and second blocks projecting sidewardly therefrom.

2. An electrical connector for mating with a complementary connector, comprising:

an insulative housing defining a receiving space therein;

a plurality of terminals attached to the housing;

a drive member being movably received in the receiving space between a first position and a second position;

a movable beam member received in the receiving space and having a latch releasing portion at a free end thereof; and a latch cooperating with the latch releasing portion for engaging with a hook of the complementary connector;

wherein when the drive member pulls the movable beam member rearwardly from the first position to the second position in a longitudinal direction, the latch releasing portion deflects the latch for separating from the hook of the complementary connector in a lateral direction, thereby the connector being released; when the drive member pushes the movable member forwardly from the second position to the first position, the latch releasing portions make the latch to resume to original position for engaging with the hook of the complementary connector; wherein the drive member comprises a head at one end thereof and a fixing end at the other end thereof; wherein the fixing end has external threads at a rearmost end thereof; wherein when the connector is mated with a complementary connector, the external threads engaging with nuts of the complementary connector for adjusting the engagement between the connector and the complementary connector by operating the head.

3. The electrical connector as described in claim 2, wherein the housing is made of metallic material.

4. The electrical connector as described in claim 3, wherein the housing has a mating frame formed on a front end thereof and a terminal insert assembled into the mating frame.

5. The electrical connector as described in claim 4, wherein the terminals are received in the terminal insert.

6. The electrical connector as described in claim 5, wherein the housing defines an elongated channel on one side thereof for receiving the latch.

* * * * *